US005145182A

United States Patent [19]

Swift et al.

[11] Patent Number: 5,145,182

[45] Date of Patent: Sep. 8, 1992

[54] BOARD GAME WITH LASER BEAM PATHS

[75] Inventors: Philip Swift; Eric Swift, both of Moorestown, N.J.; Terrence L. Glatt, Oakland Park, Fla.

[73] Assignee: Entercon Technologies, Inc., Moorestown, N.J.

[21] Appl. No.: 613,356

[22] Filed: Nov. 15, 1990

[51] Int. Cl.[5] ..... A63F 3/00; A63F 9/24

[52] U.S. Cl. ..... 273/238; 273/237; 273/310; 273/460

[58] Field of Search ..... 273/237, 238, 310–312, 273/433, 460

[56] References Cited

U.S. PATENT DOCUMENTS 3,516,671 6/1970 Estrin ..... 273/238

3,911,598 10/1975 Mohon ..... 273/310

*Primary Examiner*—Benjamin Layno

*Attorney, Agent, or Firm*—Malin, Haley, McHale, DiMaggio & Crosby

[57] ABSTRACT

A board type game which utilizes lasers where players selectively divert the path of laser beams. The board apparatus comprises an enclosed chamber formed by a top and bottom piece and a frame piece within which laser beams are directed down symbolic rows and columns constituting a matrix of squares. Each square has an X-shaped slot along the diagonals of the square. These slots are formed in the bottom piece and top piece. Deflecting pieces, which may be mirrors, are placed at the player's discretion in diagonal slots of an X-shaped to deflect an incident laser beam from a row or column to a corresponding column or row. A scoring module, sensitive to incident laser light, is positioned in the chamber in front of each player. The players alternate in placing deflecting pieces in the chamber with the object to either direct their laser beams toward the opponent's scoring module or to prevent their opponent's laser beams from reaching their own scoring module.

33 Claims, 9 Drawing Sheets

BOARD GAME WITH LASER BEAM PATHS

BACKGROUND OF THE INVENTION

1. Field of the Invention

This invention relates 9enerally to board type games and more particularly to a laser game which selectively diverts laser beams by user-placed mirrors 2. Description of the Related Art Many board games have been provided which use paths across their surface as part of the game. An example of such games is STIX by Avalon Press In addition, games exist that depend on the deflection or reflection of objects off of other objects to "score" points An example of a board game that combines the features of the players creating paths and the deflection of the paths is found in U.S. Pat. No. 3,516,671 issued to Gerald Estrin on Jun. 23, 1970. The Estrin patent shows a board game having a matrix comprised of rows and columns and an energy source which can be selectively positioned to direct energy along a selected column, thereby creating an energy path. The energy path may be diverted to a row and then back to a column by deflecting pieces The deflecting pieces may be small mirrors.

However, Estrin does not contemplate laser technology nor the unique elements or rules of the instant invention.

SUMMARY OF THE INvENTION

The invention comprises a chamber, formed by a top and bottom piece and a frame piece, within which laser beams are directed down symbolic rows and columns constituting a matrix. The intersection of a row and column is called a square. Deflecting pieces, which may be mirrors, are placed at the players' discretion diagonally across the squares to deflect an incident laser beam from a row or column to a corresponding column or row. X-shaped slots are formed in the bottom piece and may be correspondingly formed in the top piece diametrically opposed to the X-shaped slots in the bottom piece, to receive and precisely position the deflecting pieces within the chamber.

A scoring module, essentially cube-shaped which is sensitive to incidnnt laser light, is centered at each end of the chamber at a particular square in front of the players. Home base squares are provided directly in front of the four faces of the cube-shaped scoring module. These home base squares detect the presence of a deflecting piece in the home base square.

In operation, laser beams are directed down rows and columns adjacent to the edges of the frame from laser housings in the corners of the chamber. The two laser housings closest to each player are considered to be that player,s lasers. Each player's laser oeams may be of a different color to distinguish the beams and to aid in the determination of a score. The players alternate in placing deflecting pieces in the chamber with the object to either direct their laser beams toward the opponent's scoring module or to prevent their opponent's laser beams from reaching their own scoring module.

A score is recorded when a laser beam of one player strikes the scoring module of the other player and that laser beam was deflected into the scoring module by a deflecting piece placed in a home base adjacent to the scoring module.

Impurities, such as smoke or fog, are introduced into the chamber enhancing the visibility of the laser beams for the players and observers.

DESCRIPTION OF THE PREFERRED EMBODIMENT

Figure 1:
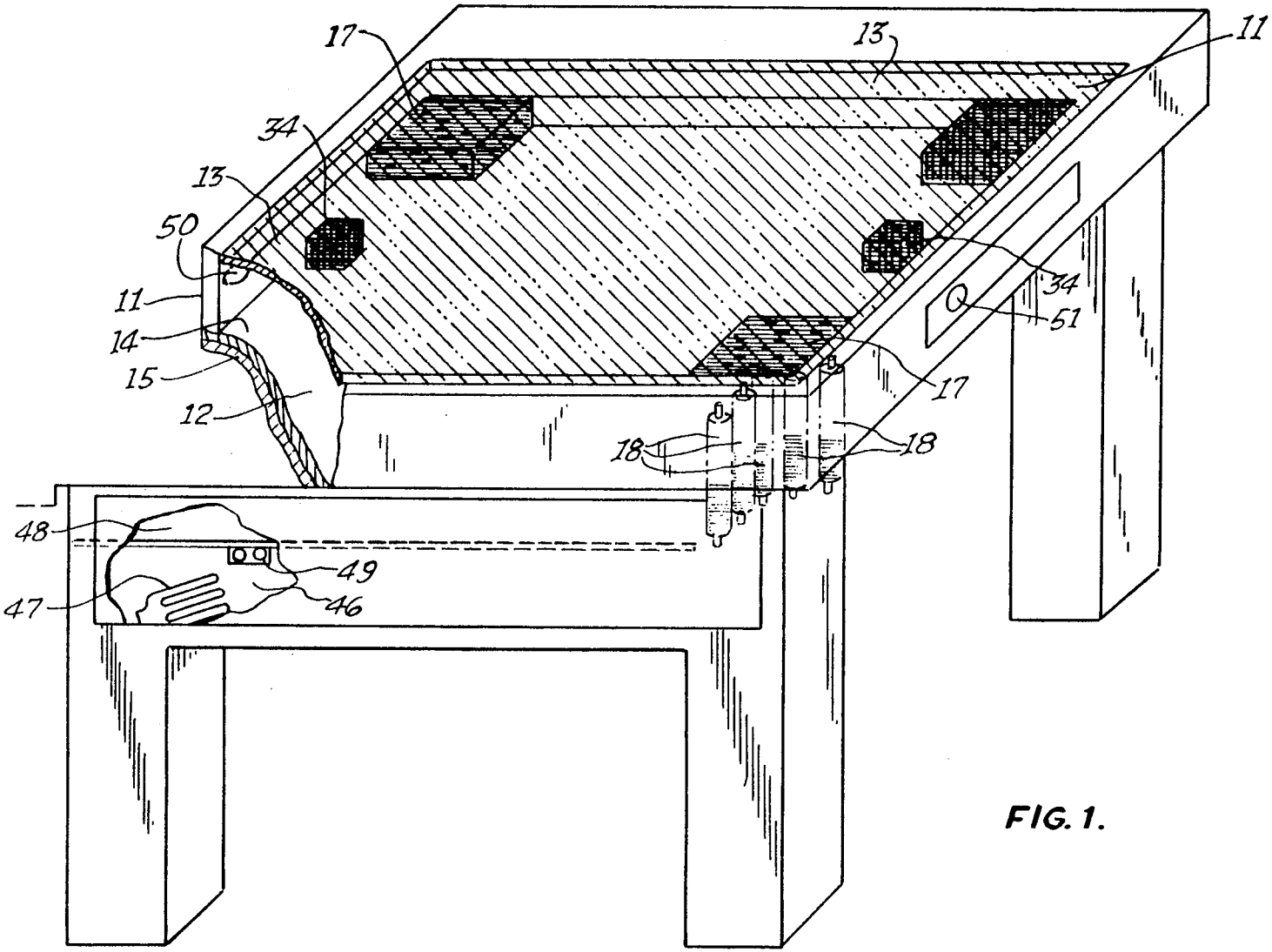
FIG. 1 is a perspective view of an embodiment of the invention illustrating the placement of system components.

FIG. 1 illustrates a perspective view of the preferred embodiment of the laser game 10 for two players, including the relative placement of the elements. Although the preferred embodiment is played by two players, obvious modifications of the game allow for a greater number of players or for a single player playing against a computer The basic elements of the invention 10 are a table having a frame 11, top piece 13, bottom piece 14, laser housing 17, home base 30, mirror assemblies 40, and scoring module 34. All elements except the mirror assemblies 40 are mounted within frame 11 and below the top piece 13 to protect the elements.

Figure 2:
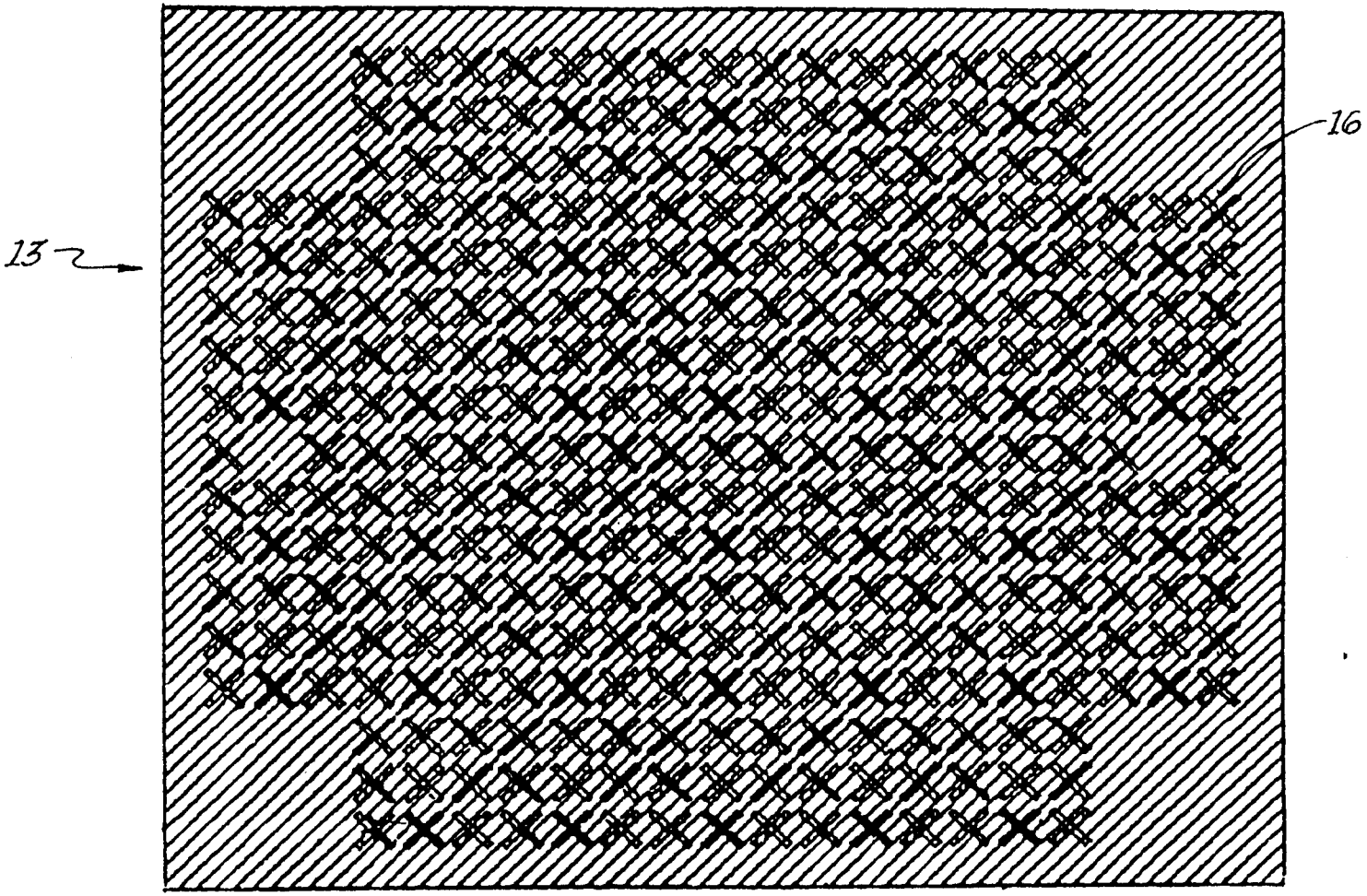
FIG. 2 is a top view of the upper glass sheet of the invention shown in FIG. 1.

In FIG. 2 is shown the top piece 13 which is suspended by its edges from the frame 11. In the preferred embodiment, the top piece 13 is rectangular in shape, with the players positioned opposite one another at the shorter sides of the rectangle. The top piece 13 is made of a clear rigid material and is supported at its center by a center support 32. A polycarbonate such as PLEXIGLASS or acrylic has been found to be most effective. The top piece 13 is of a sufficient thickness to provide durability and support for any stress that may be placed on it by patrons leaning on it or placing objects on it. In addition, the top piece 13 should be of a sufficient thickness to maintain a substantially planar surface from its edges at the frame 11 to the center support 32. A one-half inch thickness of PLEXIGLASS has been found to be particularly effective.

Figure 4:
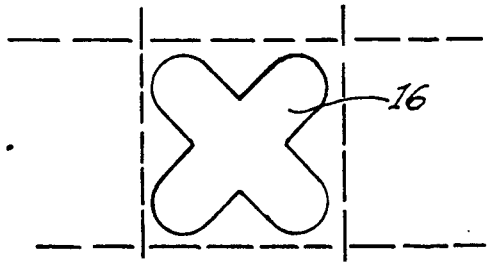
FIG. 4 illustrates an x-slot as utilized in the present invention.

Rows and columns having identical widths are symbolically laid out on the top piece 13 with the rows running across the short side of the top piece 13 and columns along the long side. In the preferred embodiment there are twenty-one columns and seventeen rows, although the principles of the game are not dependent on the number of rows or columns. The intersection of a column or row symbolically constitutes a square. Running across the diagonals of selected squares, are "x-slots" 16 which are x-shaped slots cut through the top piece 13. FIG. 4 shows a close-up of an x-slot 16. As can be seen, the outermost edges of the x-slot 16 are curved for better contact with mirror assemblies 40 which will be described in more detail below. The x-slots 16 are preferably etched by a computer controlled milling machine to achieve precise location of the x slots 16. The importance of precision in positioning the x-slots 16 is described in connection with the misalignment problem hereafter.

In each of the corners of the top piece 13, in a configuration of nine squares placed 3×3, no x-slots are cut. The purpose for eliminating x-slots in the corners will be explained hereafter. Also, at the intersection of the center row and the second column from each end are two squares without x-slots. These squares are designated the scoring module square.

Figure 3:
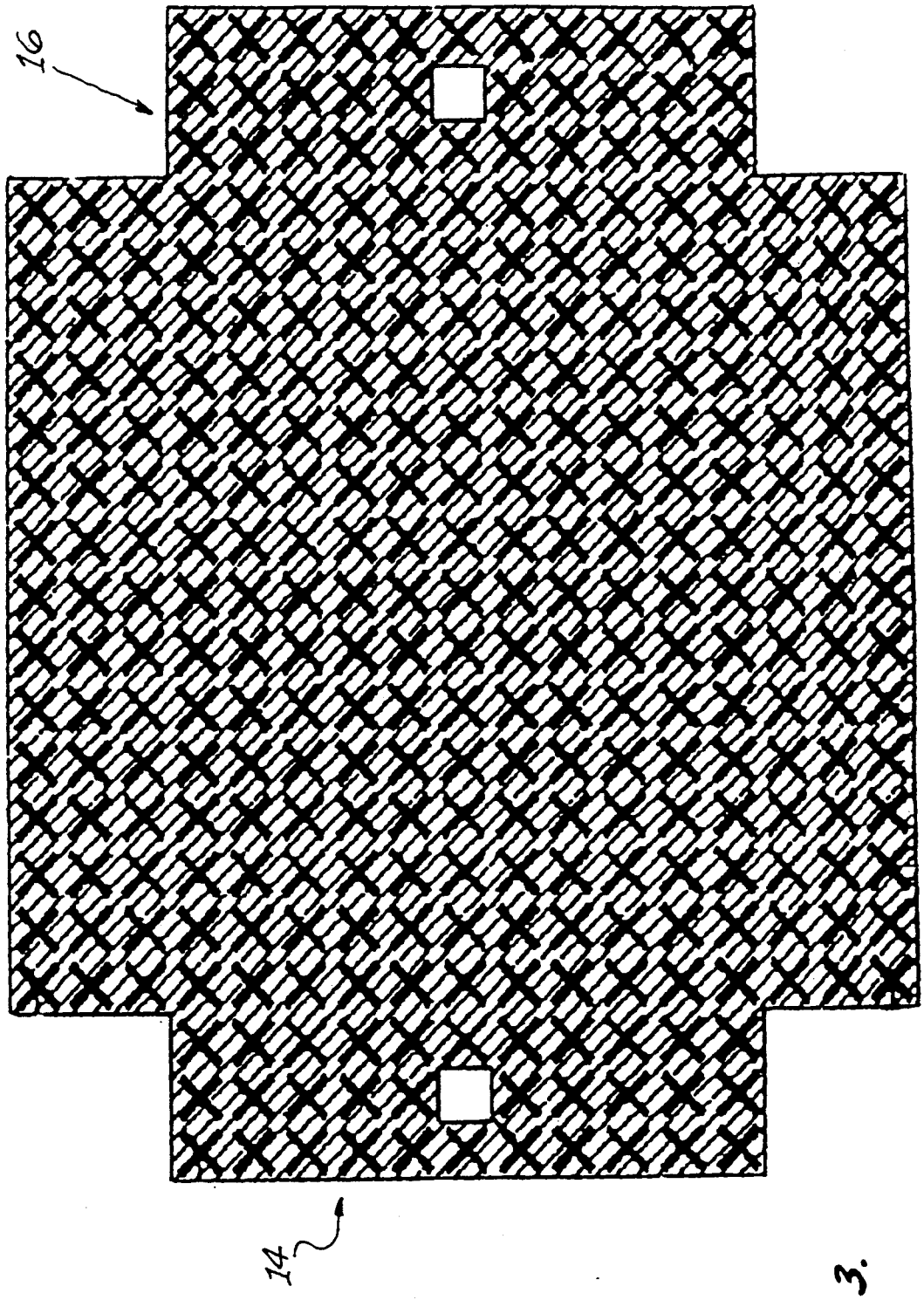
FIG. 3 is a top view of the lower glass sheet of the invention shown in FIG. 1.

In FIG. 3 is shown the bottom piece 14, which corresponds in shape to the top piece 13. The bottom piece 14 is also made of a clear rigid polycarbonate such as PLEXIGLASS or acrylic, but need not be as thick as the top piece 13. One-quarter inch PLEXIGLASS has been found to be an effective thickness for the bottom piece 14. X-slots 16 may be etched into the bottom piece 14 in corresponding position with the x-slots 16 which are etched into the top piece 13. The corners of the bottom piece 14 are removed corresponding in shape to the area of the top piece 13 which does not have x-slots. In addition, the two squares corresponding to the scoring module squares on the top piece 13 are removed from the bottom piece 14. The bottom piece 14 rests upon a support element 15, supported by the frame 11 as illustrated in FIG. 1. The support piece 15 corresponds in shape to the bottom piece 14.

The frame 11 holds the top piece 13 a distance above the bottom piece 14 thereby creating a chamber 12 enclosed on top and bottom by the top piece 13 and bottom piece 14 and on the sides by the frame 11.

Figure 5:
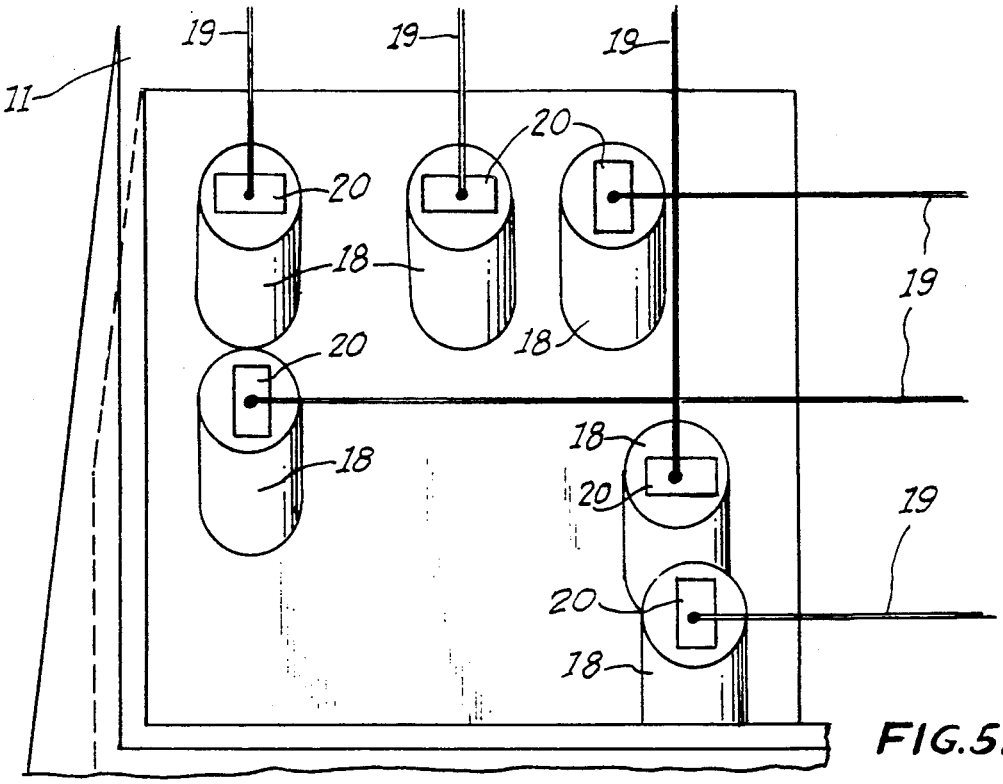
FIG. 5 is a top perspective view of the laser housing illustrating the projection of laser beams along rows and columns.

Laser housings, corresponding in shape to the truncated area at the corners of the bottom piece 14, are placed in each corner of the bottom piece 14. In the preferred embodiment, each laser housing 17 contains six lasers 18, comprising a total of twenty-four. Lasers 18 are connected to laser housing 17 by common clamp-type mounts. The power supplies for the lasers 18 are placed below the frame 11. Also in the preferred embodiment, the lasers 18 are oriented in a substantially vertical direction so that the laser beams 19 extend upward from the lasers 18 as shown in FIG. 5.

Laser beams 19 are diverted from the vertical direction to the horizontal direction by adjustable hemispherical directors 20 which will be described in greater detail below. The purpose of the adjustable hemispherical directors 20 is to direct the laser beams 19 down the center of an appropriate row or column, precisely between the top and bottom pieces 13, 14. FIG. 5 depicts the arrangement of the lasers 18 within the laser housing 17 so that three laser beams 19 each are directed down consecutive rows and three laser beams 19 are directed down consecutive columns. The offset arrangement of the laser beams is necessary to allow for laser beams 19 to be projected along the row and column corresponding to the corner of the laser housing 17 entirely surrounded by the chamber 12. Although the preferred embodiment uses twenty-four lasers 18, fewer lasers may be used when laser beams 19 are split into 24 separate laser beams by commercially available means such as beam splitters.

Although the invention is being, described in its preferred embodiment of twenty-four separate lasers, a greater or lesser number may be used. Twenty-four lasers has been found to be a most effective number to create a challenging game and produce striking visual effects.

Although any suitable laser may be used, Helium-Neon lasers which produce a characteristic red light at about 6328 Angstrom wavelength have been found to be reliable, inexpensive and producing a striking visual effect. Other types such as a Krypton laser having a yellowish-green light corresponding to a wavelength of 5680 Angstroms may also be used.

Figure 6:
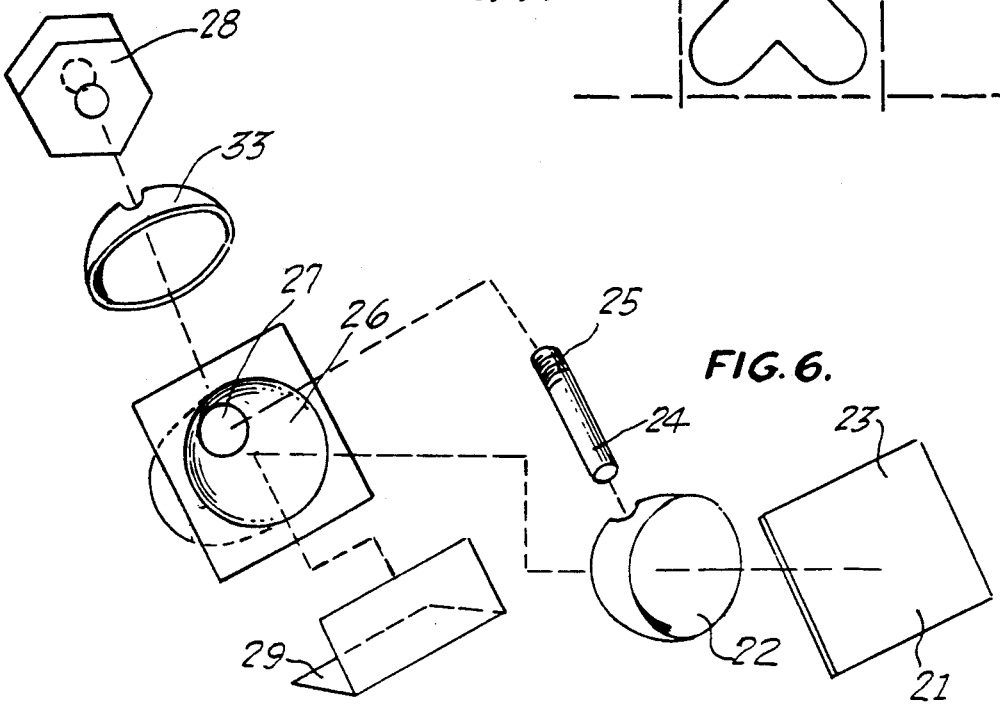
FIG. 6 is an exploded view of an adjustable hemispherical director utilized in the invention.

Adjustable hemispherical directors 20, shown in FIG. 6, are provided to change the direction of the vertical laser beams 19 to precisely directed horizontal beams. The adjustable hemispherical directors 20 comprise a mirror 21 rigidly attached to a hemisphere 22. In the preferred embodiment, hemisphere 22 is made of a hard plastic polymer, but may also be made of a pliable material such as a synthetic rubber. The mirror 2! is coated with a reflecting surface 23 on only one side, that mirrored side being directed away from the hemisphere 22. Extending from the center of the hemisphere 22, through the hemisphere 22, is a shaft 24. A threaded end 25 extends away from the hemisphere 22. A concave socket 26, corresponding in size and shppe to the hemisphere 22 is provided The socket 26 is made of a rigid material such as a hard plastic polymer. The socket 26 has an aperture 27, larger in diameter than the threaded shaft 24, extending through the socket 26 to receive the threaded shaft 24. In operation, the hemisphere 22 is brought into physical contact with the socket 26 and the threaded end 25 is directed through the aperture 27. A spherical shell shaped washer 33, with its inside radius of curvature equal to the radius of curvature of the outside surface of socket 26, is placed over the threaded end 25 of shaft 24. A nut 28 is then threaded on threaded end 25 Nut 28 is then manipulated along the threaded end 25 to come into contact with washer 33 bringing washer 33 into contact with socket 26. This draws the hemisphere 22 into frictional contact with socket 26. The fact that the aperture 27 is larger than shaft 24 allows for precise positioning of mirror 21 by movement of the hemisphere 22 within the socket 26 in a "joy stick" manner prior to the socket 26 being brought into frictional contact with the hemisphere 22 by the corresponding movement of the shaft 24 through the aperture 27. Once the nut 28 is secured against the socket 26, the hemisphere 22, and consequently the mirror 21, is securely held in position relative to the socket 26. Socket 26 has a mounting bracket 29 which allows socket 26 to be mounted to the laser housing 17 above the lasers 18 so that an upwardly directed laser beam 19 may contact the mirror 21 of the adjustable hemispherical directors 20 and be directed in a precise horizontal direction down a selected row or column.

Although adjustable hemispherical directors 20 have been found to be particularly useful in re-directing the laser beams 19, any means for directing the laser beams 19 such as mirror assemblies or prisms may also be used. In addition, the lasers themselves may be arranged so as to direct the laser beams 19 down the selected rows or columns.

Figure 7A:
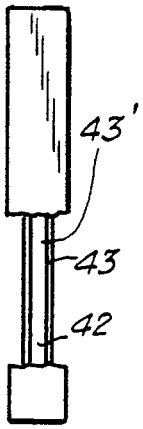
FIG. 7A is a side view of the mirror assembly illustrated in FIG. 7.

Mirror assemblies 40 are also provided to change the direction of the laser beams 19 which are directed along respective columns or rows. As shown in FIG. 7A, the mirror assemblies 40 have a thin glass substrate 42 and mirror coatings 43, 43'. The mirror coating 43, 43' are placed on both sides of the substrate 42, and are of a sufficient thickness to reflect virtually all of an incident laser beam 19. The thickness of the substrate 42 is 0.030 inch and the thickness of each coating 43, 43' is a few microns so that the entire thickness of the substrate 42 and coatings 43, 43' is approximately 0.030 inch. The reason for the thinness of the combined substrate and coatings is discussed below with respect to the displacement problem. The mirror coatings 43, 43' are applied directly to the substrate 42 to form "first surface" mirrors.

Figure 7:
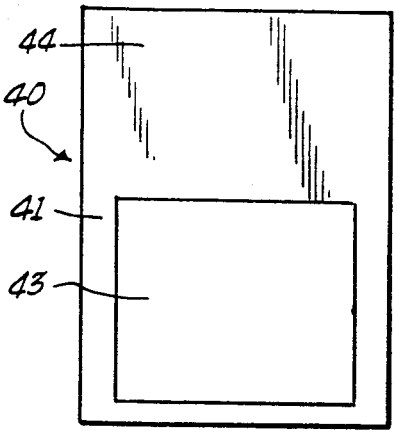
FIG. 7 is a front view of one embodiment of a mirror assembly.
Figure 8:
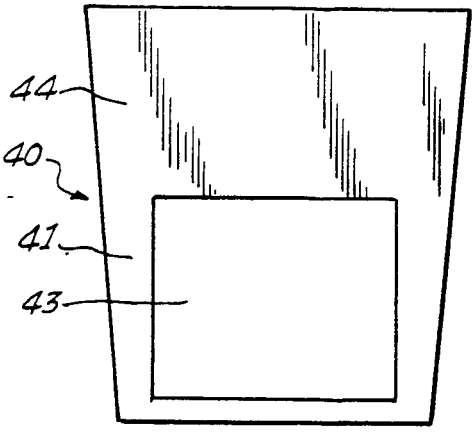
FIG. 8 is a front view of an embodiment of the mirror assembly illustrating wedqe-shaped sides for self-alignment of the mirror assembly.
Figure 9:
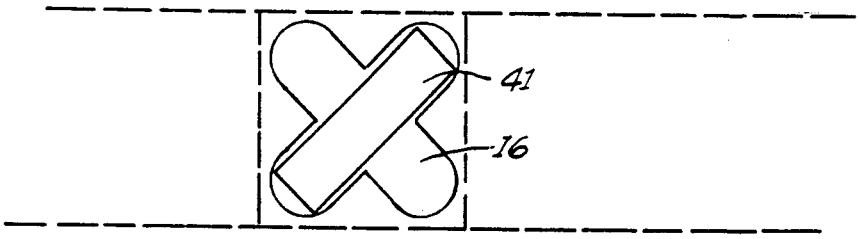
FIG. 9 is a top view illustrating wedging interaction between the x-slots and the mirror frame.

Also included in the mirror assembly 40 is a mirror frame 41 as shown in FIG. 7. The mirror frame 41 allows the mirror assembly 40 to be positioned within the x-slots 16 of the top and bottom pieces 13, 14. In the preferred embodiment, the mirror frames 41 are comprised of a rigid material such as plastic which surrounds the glass substrate 42 and the coatings 43, 43' and includes a handle 44 so that a player may effectively manipulate the mirror assembly 40. As shown in FIG. 9, the mirror frame 41 is of sufficient size, both in width, and depth, so that when it is placed in the x-slots 16, the edges of the mirror frame 41 will contact the curved outer edges of the x-slots 16 to securely hold the mirror assembly 40 in place. In addition, as shown in FIG. 8, the mirror assembly 40 may be wedge shaped from top to bottom to create a wedging effect of the contact between the mirror assembly 40 and the outer edges of the x-slots 16.

Figure 10:
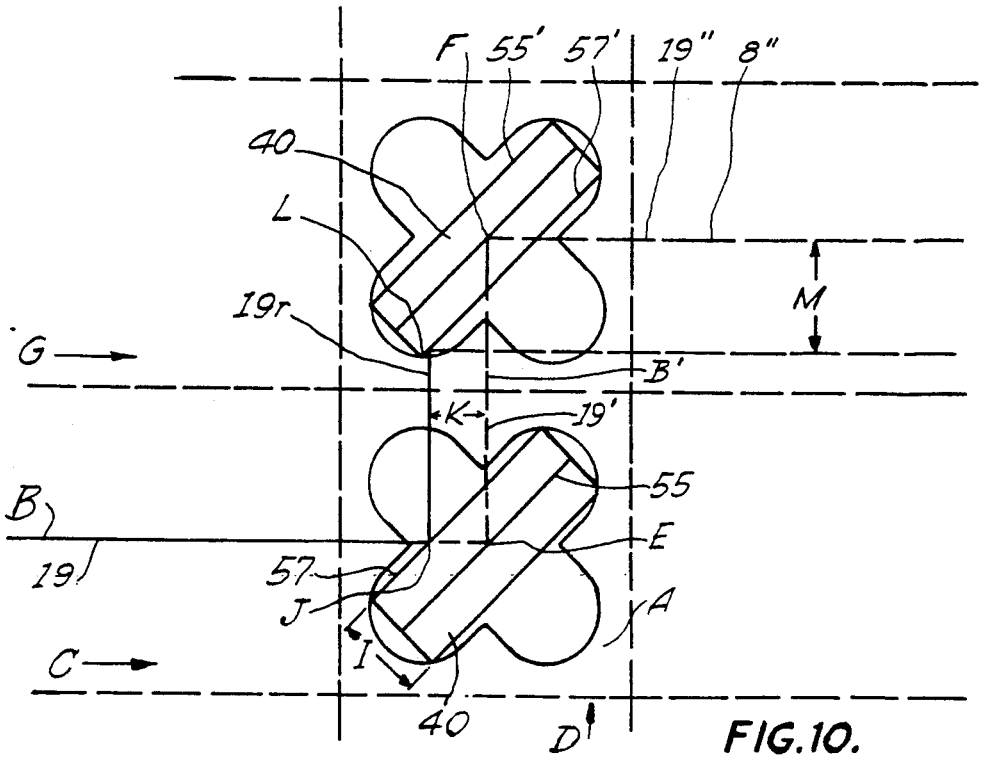
FIG. 10 is a diagram illustrating the displacement phenomena.

The purpose of the contact between the mirror assembly 40 and the outer edge of the x-slot 16 is to precisely position the mirror assembly 40 within the x-slot 16. It is of critical importance to maintain the laser beam 19 as close as possible to the center axis of the respective row or column. As shown in FIG. 10, if a laser beam 19 is displaced from the center axis of a row or column, but in a path parallel to the oenter axis, that displacement will be proliferated on all subsequent reflections. In FIG. 10, by way of example of the displacement problem, a perfect reflecting surface 55 is shown. The perfect reflecting surface 55 is infinitely thin and precisely placed across the diagonal of square A. A laser beam 19, coincident with central axis B of row C will be incident on reflecting surface 55 at point E and be reflected down column D. The reflected laser beam 19', shown in broken line, will be reflected down the central axis B' of column D. Subsequent contact of the laser beam 19' with another perfect reflecting surface 55' at point F will result in reflected laser beam 19'', also shown in broken line, being reflected along the central axis B'' of row G.

In operation, no such infinitely thin reflecting surface 55 exists Instead, a reflecting surface 57 will have a finite width I based on the width of the substrate which has the reflecting surface coating. A laser beam 19 coincident with central axis B of row C will be reflected off of reflecting surface 57 at point J which will result in the reflected laser beam $19_r$ being displaced from the central axis B' of column D by a distance K.

Reflected laser beam $19_r$ will be reflected off of reflecting surface 57' at L and be directed down row G displaced a distance M from the central axis B'' of row G. As can be seen, displacement M is larger than displacement K. Subsequent reflections will compound this error causing even greater displacement with the result that laser beam 19 will move to the edge of a row or column where it may not strike a mirror assembly 40 or may strike an edge of the mirror assembly 40 and be misdirected.

In order to minimize displacement due to the width I, it is extremely important to make the width of the glass substrate 42 and coatings 43, 43' of the mirror assembly 40 as small as possible In practice, a combined width of the substrate 42 and coatings 43, 43' of about 0.030 inch has been found to be as small as practical to maintain sufficient rigidity in the mirror assembly 40 and reflectivity of the coatings 43, 43'. The problems associated with detecting a displaced beam will be discussed more fully in conjunction with the scoring module.

Figure 11:
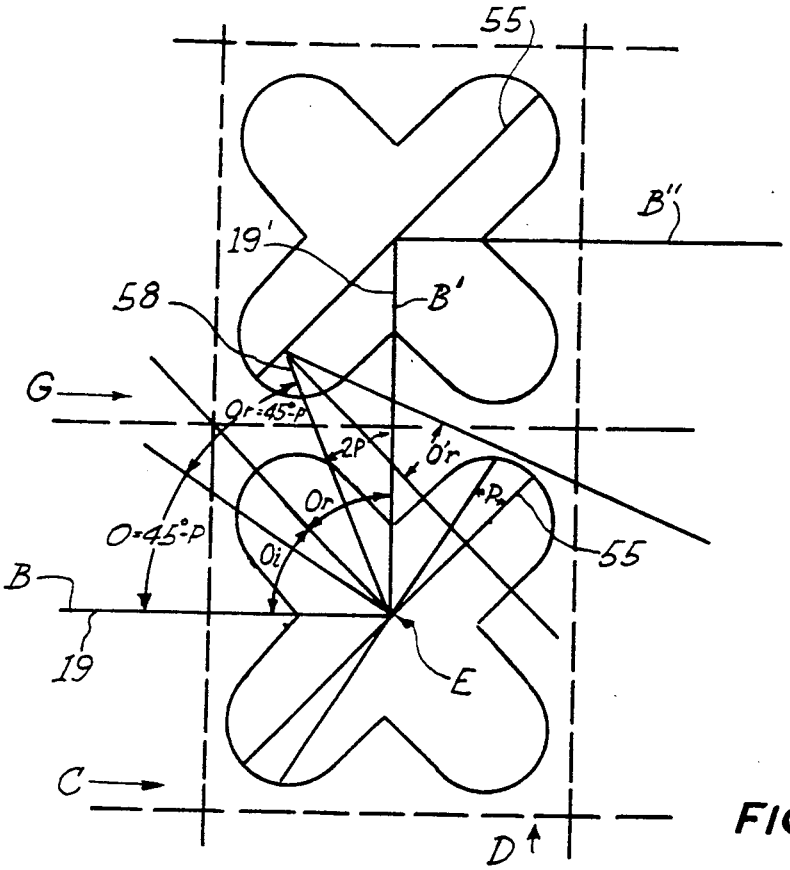
FIG. 11 is a diagram illustrating misalignment and the divergent phenomena.

A more serious problem occurs when a laser beam 19 is directed at an angle to the central axis as shown in FIG. 11. This occurs primarily by a deviation of the mirror assembly 40 from the diagonal of a square because of misalignment of the x-slot 16 and the mirror assembly 40.

In FIG. 11, B, B', and B'' are the central axis of row C, column D, and row G respectively. Laser beam 19, coincident with central axis B strikes perfect reflecting surface 55 at point E and is reflected according to Snell's law (modified for no change in index of refraction): Angle of incidence ($O_i$)=Angle of reflection ($O_r$). If perfect reflecting surface 55 is precisely aligned across the diagonal of square A, $O_i$=45, $O_r$=45, and laser beam 19' is reflected coincident with central axis B'.

If, however, perfect reflecting surface 55 is misaligned from the diagonal of square A by an angle P, $O_i$=45-P and $O_r$=45-P. This results in reflected laser beam 58 diverging from the central axis B' of column D by the angle P. Given a sufficient path length, reflected laser beam 58 will eventually leave the boundaries of column D. If reflected laser beam 58 subsequently is incident on another perfect reflecting surface 55', the divergent laser beam 58 will be reflected off of perfect reflecting surface 55' at $O'_r$=45-2P, so the divergent character of laser beam 58 will be magnified through the reflection.

In addition to continuing the divergent characteristic of laser beam 58, the laser beam 58 will be displaced a distance N from the central axis B' of column D. This combines the displacement problem mentioned above with the divergent problem, with the effect that reflected laser beam 58' will even more rapidly diverge from the central axis B'' of row G. Of course, if perfect reflecting surface 55, is itself misaligned, the divergent effect may be multiplied with disastrous results. For this reason, it is critical that the reflecting surfaces 43, 43' of mirror assemblies 40 be precisely aligned with the diagonals of the squares where the mirror assemblies 40 are placed. The wedging effect of the mirror assembly 40 with the x-slots 16 prevents this misalignment problem when the x-slots 16 themselves are precisely positioned.

Figure 12:
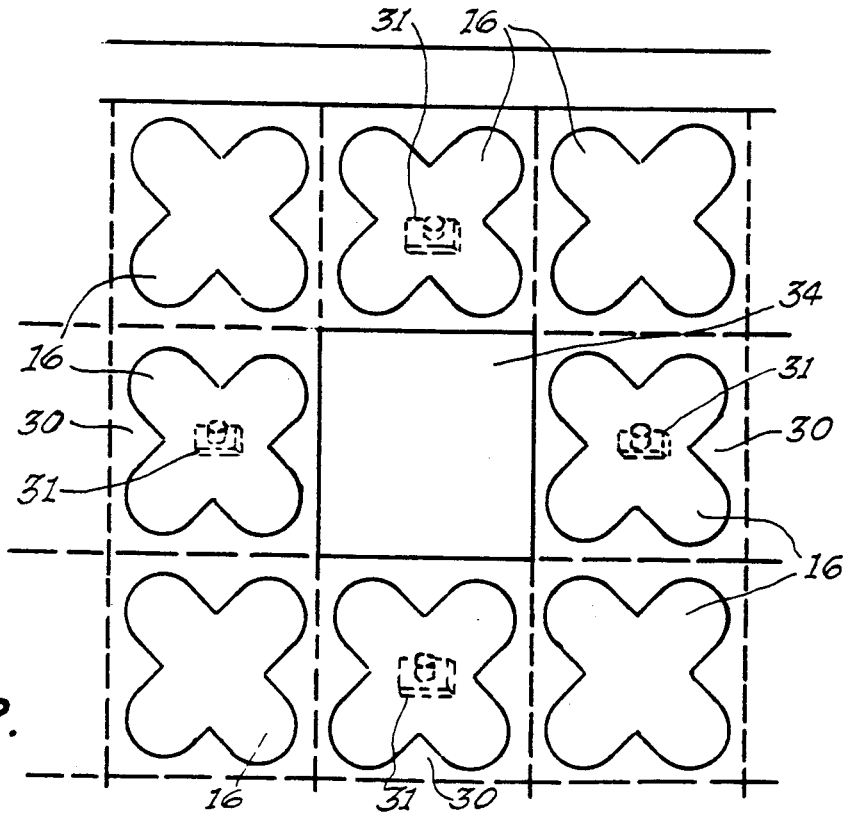
FIG. 12 is a top, block view of the home base and scoring module utilized in the invention.
Figure 15A:
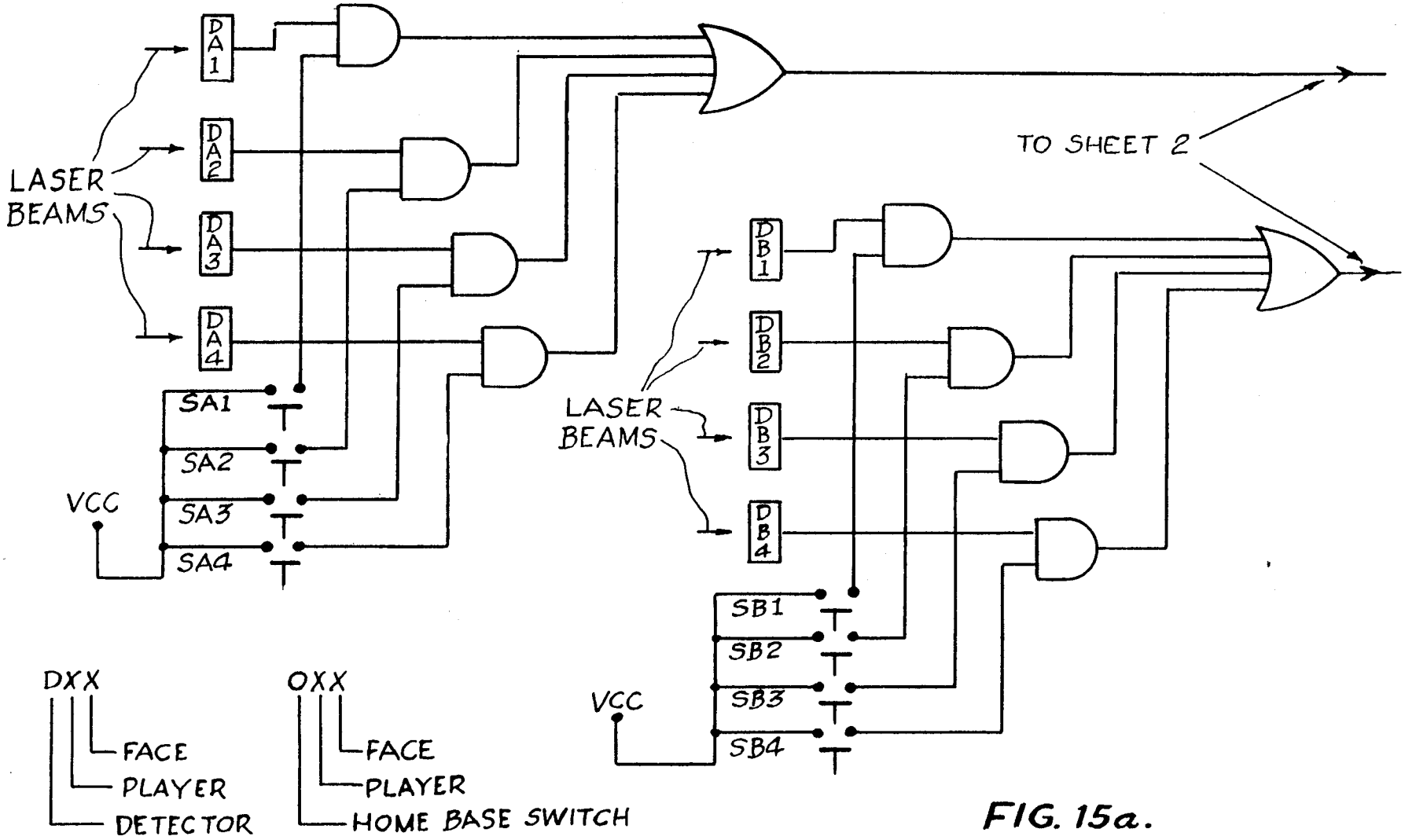
FIGS. 15*a, b* is a schematic diagram of the score detection circuitry.
Figure 15B:
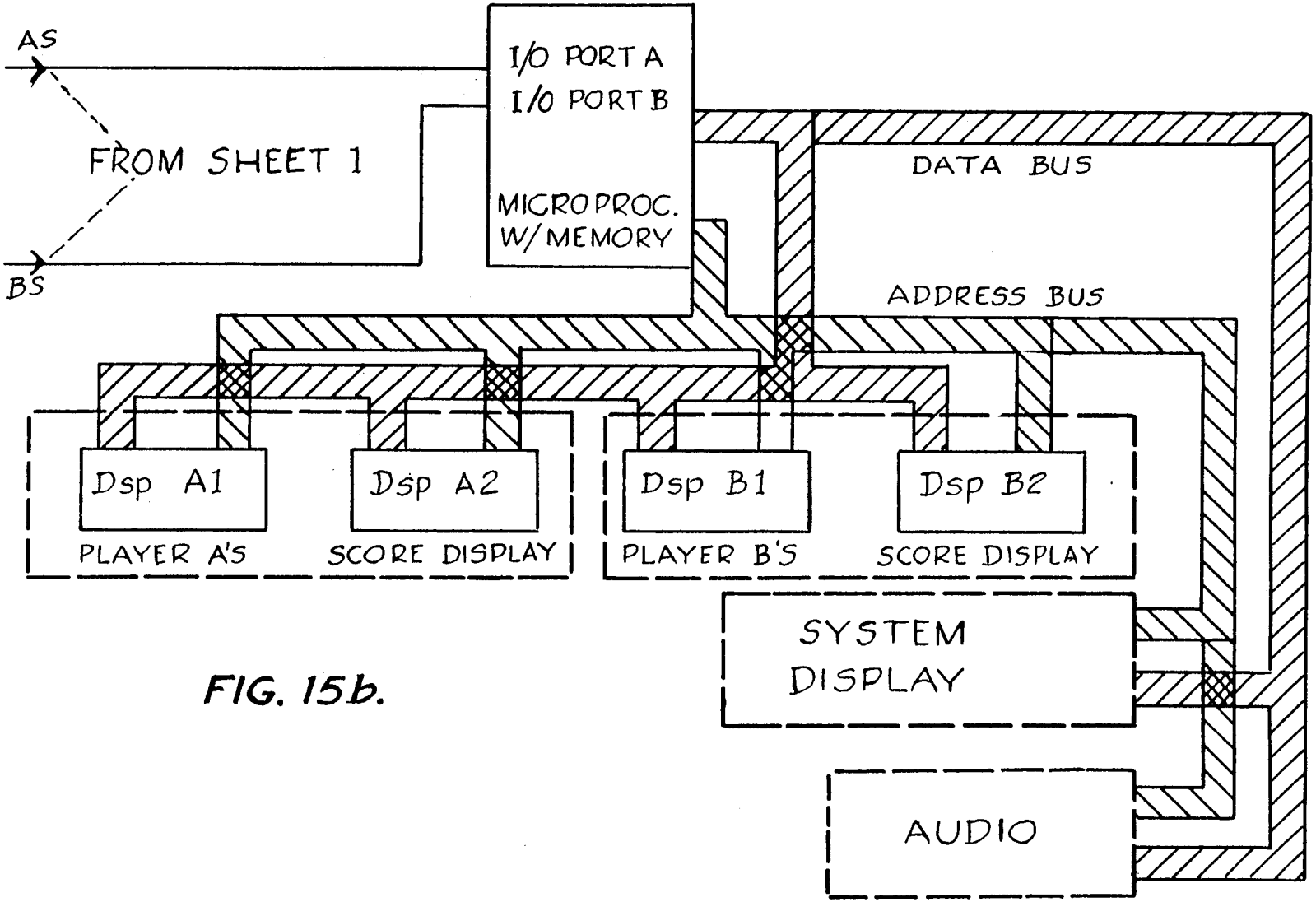

A home base 30 is provided which comprises the 4 squares directly facing the sides of the scoring module 34 as shown in FIG. 12. Located in each x-slot 16 of the home base 30 on the bottom piece 14 is a push button switch 31 which responds to the downward pressure of a mirror assembly 40 placed in the corresponding x-slot 16. Electronic circuitry is provided to detect the closure of the switches 31. This electric circuitry works together with the electric circuitry of the scoring module 34 as shown in FIG. 15*a, b* and as described below.

Figure 13:
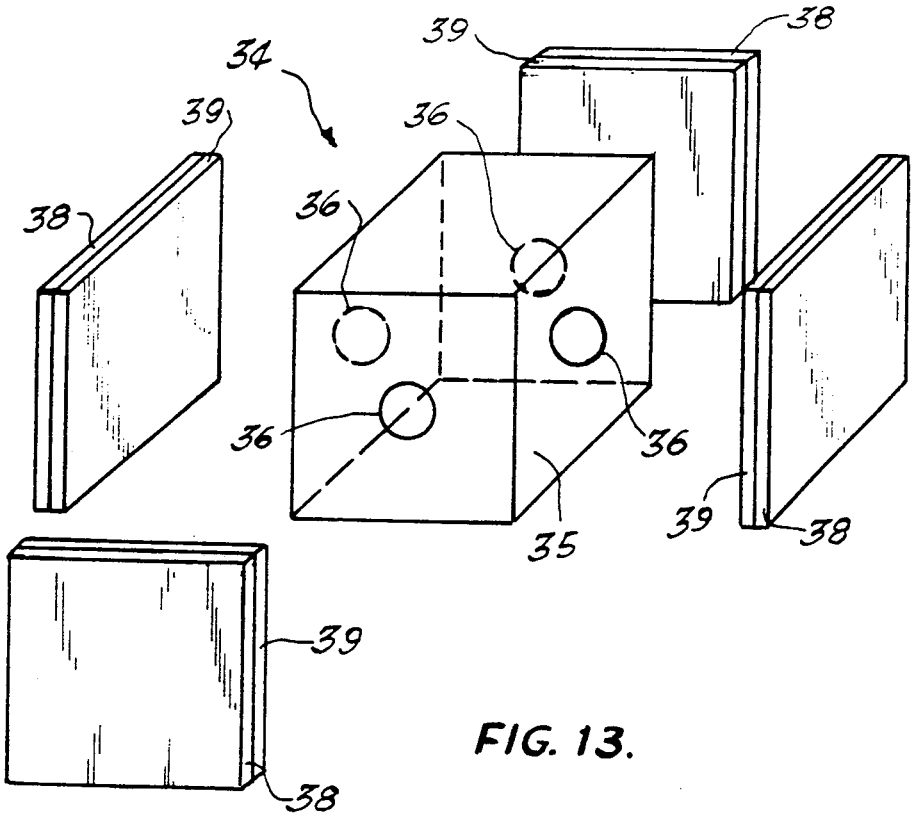
FIG. 13 is an exploded perspeotive view of the scoring module.

As shown in FIG. 13, the scoring module 34 consists of a cube 35 containing means for detecting laser light directed outward from the faces of the scoring module 34 which face the chamber 12. In the preferred embodiment, the means for detecting laser light are photo PIN diodes 36, responsive to the incidence of light upon them as will be described hereafter. Electronic circuitry is provided to detect the incidenc,e of light 19 upon the photo PIN diodes 36 and generate control signals.

Because the cross-sectional beam width of the laser beam 19 and the diameter of the photo PIN diodes 36 are both comparatively small, and because of the misalignment and displacement problems discussed above, there is a possibility that although a laser beam 19 may be incident on the scoring module 34, it may not be incident upon the photo PIN diodes 36 on the face of the scoring module 34. To remedy this problem, a diffusing polycarbonate 38 having a phosphorescent die which fluoresces when impinged upon by light of the frequency of the laser beams used in this invention is placed on the sides of the scoring module 34 between the photo PIN diodes 36 and the incident laser beam 19. The phosphorescent die radiates an infra-red wavelength emission when impinged by the laser beams of the instant invention. The purpose of this diffusing polycarbonate 38 is to diffuse the incident laser light, which laser light causes a phosphorescent "glow" in the infrared range thus making a larger effective cross-section of the laser beam 19, thereby increasing the probability that the laser beam 19 will be incident on the photo PIN diodes 36. In this preferred embodiment, the photo PIN diodes 36 are sensitive to infra-red light instead of the light of the laser beams 19.

Instead of the diffusing polycarbonate 38 having a phosphorescent die, an ordinary diffusing polycarbonate which merely diffuses the incident light may also be used. The purpose of this ordinary diffusing polycarbonate is to diffuse the incident laser beam making a larger effective cross-section of the incident laser beam 19. When using this ordinary diffusing polycarbonate, the phono PIN diodes 36 will be of the type sensitive to the wavelength of the laser beams 19 used in the invention.

In addition to placing diffusing filters 38 between the phototransistors 36 and the incident laser beam 19, a first surface reflective coating 39 is provided adjacent to the diffusing filter 38 on the side of the diffusing filter 38 opposite the incident laser beam 19. The reflective surface 39 is directed into the diffusing material 38, that is, in the direction toward the incident laser beam 19. The purpose of this reflective coating 39 is to reflect any diffuse laser light incident upon it back into the diffusing filter 38 where it may be diffused into the photo PIN diodes 36, thus registering the presence of incident laser light. Reflective coating 39 operates like the reflective coating on the back of a cat's eye, behind their retinas, to reflect light not detected by the eye on its initial impact on the retina. This light is reflected back into the retina so there is an additional chance that the reflected light will be detected. The net effect of such a system, in detecting laser beams 19, is a greater threshold of light detection. In the preferred embodiment, the first surface reflective coating 39 is applied directly to the diffusing filter 38.

Although photo PIN diodes 36 are used in the preferred embodiment, other means responsive to laser light such as phototransistors or solar cells may also be used within the scope of the invention.

Light is visibly detected only when it is incident upon the eye. Laser light is highly collimated, that is, it is highly directional along the direction of propagation. Because of the highly directional nature of laser light, propagated laser light is often called a "laser beam". Unless a portion of the beam 19 is scattered by interaction with a foreign means such as smoke, its presence is essentially invisible to the observer. A laser beam 19 traversing an environment free of scattering means finds no material to scatter the light away from the laser beam path, and therefore none of the laser light is directed to the eye to make the laser beam 19 visible. Although the presence of a laser may be inferred by the presence of a "spot" of reflected laser light scattered off of an object, the path of the laser across such a "clean" environment will not be visible.

Therefore, in order to dramatically improve the visual effects of this game, impurities are added to the chamber 12 through which the laser beams 19 travel. In the preferred embodiment, as shown in FIG. 1 these impurities are created by heating a mixture, such as FOG/SMOKE FLUID made by Rosco, in a heating chamber 46 by a heating element 47 until it produces a smoke-type vapor. This smoke-type vapor is then directed through a series of ducts 48 and fans 49 into the chamber 12 through the x-slots 16 of bottom piece 14 or through ducts leading into chamber 12 Once in the chamber 12, portions of the laser beams 19 incident upon particles of the smoke are reflected to the viewer's eyes, making the laser beam 19 visible which facilitates play by allowing the players to follow the paths of the laser beams 19. In addition, the laser beams 19 reflecting off of the smoke in the chamber 12 creates a striking visual effect. This is the same dramatic effect highlighted by laser light shows and rock concerts.

In order to maintain the proper density of smoke or vapor so as not to block the laser beams 19, yet make the laser beams 19 visible, electronic circuitry may be provided to monitor density of the smoke and control it as need be. This electronic circuitry comprises an infrared emitter 50 and detector 51, on opposite sides of the ohamber 12 so that smoke in ohamber 12 will circulate between emitter 50 and detector 51. When the emitter 50 is emitting infrared light, the amount of infrared light which reaches the detector 51 is dependent on the density of the smoke between the emitter 50 and detector 51. The greater the density, the more infrared light is absorbed by the smoke. Electronic circuitry measures the current level at the detector 51 and initiates control signals when a predetermined level is reached. These signals control electronic circuits to turn on or off the heating element 47 in the heating chamber 46 or the fan 49 which moves the smoke created i the heating chamber 46 into the chamber 12.

Although the preferred embodiment uses an infrared detector 51 and control circuitry to automatically adjust the density of the smoke, alternate means for determining the density of smoke is within the scope of the invention. In addition, the turning on of the heater element 47 and the intooduction of the smoke into the chamber 12 by means of ducts 48 or fans 49 may also be manually controlled by the players as desired.

Control circuitry is also provided to "power up" or turn on the laser beams 19. This circuitry may selectively turn on the laser beams 19 either manually or by electronic control in a predetermined or sequential fashion. When the laser beams 19 are turned on in a sequential fashion after the chamber 12 has been filled with smoke, a dramatic visual appearance is created. This allows the laser beams to be turned on or off in an "attract mode" when used in a commercial application to attract customers to the device. When all of the laser beams 19 are turned on, the game is ready to begin.

Laser beams from the laser housings 17 closest to each player are considered that player's laser beams 19. Since there are two laser housings 17 closest to each player, each containing lasers 18, each play has twelve laser beams 19. In order to distinguish one player's laser beams 19 from the other in the event of a potential score, one player's laser beams 19 may be selectively "pulsed" at a predetermined time, to be described later in connection with the determination of whether a "score" has occurred. The "pulsing" occurs by rapidly turning on and off the laser beams 19 having the pulsing capacity. In addition, electronic circuitry is provided concurrent with laser detection in the scoring modules 34, to detect the presence of a pulsed laser beam 19. The necessity of having discernible laser beams 19 is explained in conjunction with the operation of the game.

Scoring circuitry is also provided to keep track of and display the respective score of the parties. In the preferred embodiment this circuitry counts the number of "scores" each player has achieved and displays the number visually through LED or similar devices 52.

The object of the game is to have one player's laser beams 19 strike the scoring module 34 of the opponent, laser beam 19 being reflected onto the opponent's scoring module 34 by a mirror assembly 40 placed in the opponent's home base 30.

In operation, smoke is generated and directed into the chamber 12. The laser beams 19 are then "powered up" and directed down the rows or columns closest to the edges of the frame. The pulsing circuitry of one set of lasers is not activated at this time. A player chosen to go first begins the game by placing one of the mirror assemblies 40 into one of the x-slots 16. If the mirror assembly 40 is placed in the path of one of the laser beams 19, the laser beam 19 will be redirected from its path along a respective row or column to a corresponding path along a column or row. The players then alternate placing mirror assemblies 40 in the x-slots 16. The mirror assemblies 40 may be placed with the intent to direct the player's own laser beam 19 toward the opponent's scoring module 34, or,with the intent to deflect the opponent's laser beam 19 away from the player's own scoring module 34. It is to be noted that the mirror assemblies 40 will reflect either player's laser beams 19. In addition, since both sides of the mirror assemblies 40 have mirror coatings 43, 43', laser beams 19 incident on either side of the mirror assemblies 40 will be redirected. Also, once a mirror assembly 40 is placed in an x-slot 16, it may not be removed until the end of play. In addition, only an opposing player may place a mirror assembly 40 in an X-slot 16 corresponding to the opponent's home base 30. In other words, a player may not place a mirror assembly 40 in an X-slot 16 on his own home base 30.

In the preferred embodiment, a timer is provided to measure the amount of time a player has to make a move. If the player fails to move within the designated time, that player forfeits that turn. Control of the timer and notice of the forfeiture may be controlled by a microprocessor used in conjunction with the "score" detection circuitry described below.

As stated above, in order to register a "score" a laser beam 19 must be directed upon an opponent's scoring module 34 and this laser beam 19 must be deflected off a mirror assembly 40 placed in the opponent's home base 30. The circuitry to detect a laser beam 19 directed onto a distinct face of scoring module 34 and to detect the presence of a mirror assembly 40 placed in the appropriate position in the opponent's home base 30 so as to depress push button switch 31 and to deflect the laser beam 19 into the scoring module 34 is shown in FIGS. 15*a, b*. There, control signals from the photoPIN diode 36 which responds to a laser beam 19 inoident upon it are attaohed to one input of an "AND" gate. The detection of an incident laser beam creates a logical "high" at the input to the "AND" gate. The other input of each "AND" gate is attached to the push button switch 31 directly in front of the corresponding phot PIN diode 36. Push button switch 36 is normally open and the other side of push button switch 36 is attached to a logical "high" voltage. When a mirror assembly 40 is placed in the square directly in front of a face of scoring module 34, the corresponding push button switch 36 is closed and a logical "high" is present at the input to the "AND" gate.

If both inputs to an "AND" gate are "high", representing that both an incident laser beam 19 is detected and a mirror assembly 40 is in the square directly in front of the activated photo PIN diode 36, then, the output of that "AND" gate will be "high". This logical "high" will be passed through an "OR" gate connecting all the "AND" gates corresponding to the four faces of the scoring module 34, with a microprocessor. Identical circuitry corresponding to the opponent's scoring module 34 is connected to another input port of the microprocessor.

As will be described in more detail below, the microprocessor, upon the receipt of a "high" signal from one of the scoring modules 34, may initiate "pulsing" to determine whether the incident laser beam 19 has ,resulted from the opponent If the incident laser beam "hit" on the scoring module 34 is determined to be a "score", the microprocessor may respond by generating control signals including signals to display the collective number of scores, signals to initiate an appropriate audio accolade, or any other such signals as can easily be initiated by a microprocessor.

Once the scoring module has detected the incidence of a laser beam 19 and passed this information on to the microprocessor, it is necessary to determine whether the incident laser beam 19 is the opponent's or the player's own. This is done by automatically pulsing the laser beams 19 of the one player who has the pulsed laser capability. This pulsing is done automatically in response to the detection of a laser beam 19 by the detection circuitry of the scoring module 34. If player A has the lasers with the pulsing system, and a laser beam 19 is incident upon player B's scoring module 34, player A's lasers will be pulsed. Electronic circuitry corresponding to player B's scoring module will determine whether the signal received by the detecting circuitry of player B's scoring module 34 is pulsed. If player B's scoring module 34 detects a pulsed laser beam 19, then a potential score is determined for player A. If player B's scoring module 34 does not detect a pulsed laser beam 19, then the laser beam 19 is from player B, and no potential score is recorded.

A similar procedure is followed when a laser beam 19 is detected at player A's scoring module 34. Player A's laser beams 19 are then pulsed. If a corresponding pulse is detected at player A's scoring module 34, then the laser strike is from player A's own lasers, and no potential score is recorded. If no pulse is detected, then the incident laser beam 19 is from player B, and a potential score is recorded.

As noted above, a "potential score" is determined when an opponent's laser beam 19 is incident upon a player's scoring module 34. In order for a "score" to be recorded, not only must there be an incident laser beam 19 on the scoring module 34 from the opposing player's laser sources, but the laser beam 19 must be reflected off of a mirror assembly 40 placed in the home base 30 of the opponent. As can be readily seen from the geometry of the positioning of the home base squares 30 and the scoring module 34, the mirror assemblies 40 must be placed directly in front of one of the photo PIN diodes 36 for a laser beam 19 to be directed into the photo PIN diode 36 from a mirror assembly 40 in the home base 30. When a potential score has been detected by the electronic circuitry connected to the photo PIN diode 36, additional logic circuitry is implemented to determine whether the push button switch 31 of the home base square 30 in front of the photo PIN diode 36 having laser light incident upon it, is depressed. If the push button switch 31 is depressed and the incident laser beam 19 is from the opposing player as determined above, a "score" is recorded. Otherwise, the game continues until the two required conditions are met.

The game may be played under a variety of conditions to determine the winner For example, a single "score" may determine the winner, or a predetermined number of scores may determine a winner In addition, there may be a time limit set where the player with the most scores in a predetermined time is the winner. These and other possible methods of determining a winner are set forth merely as examples of ways to play the game and are not meant to limit the implementation of the game as described heretofore.

Figure 14:
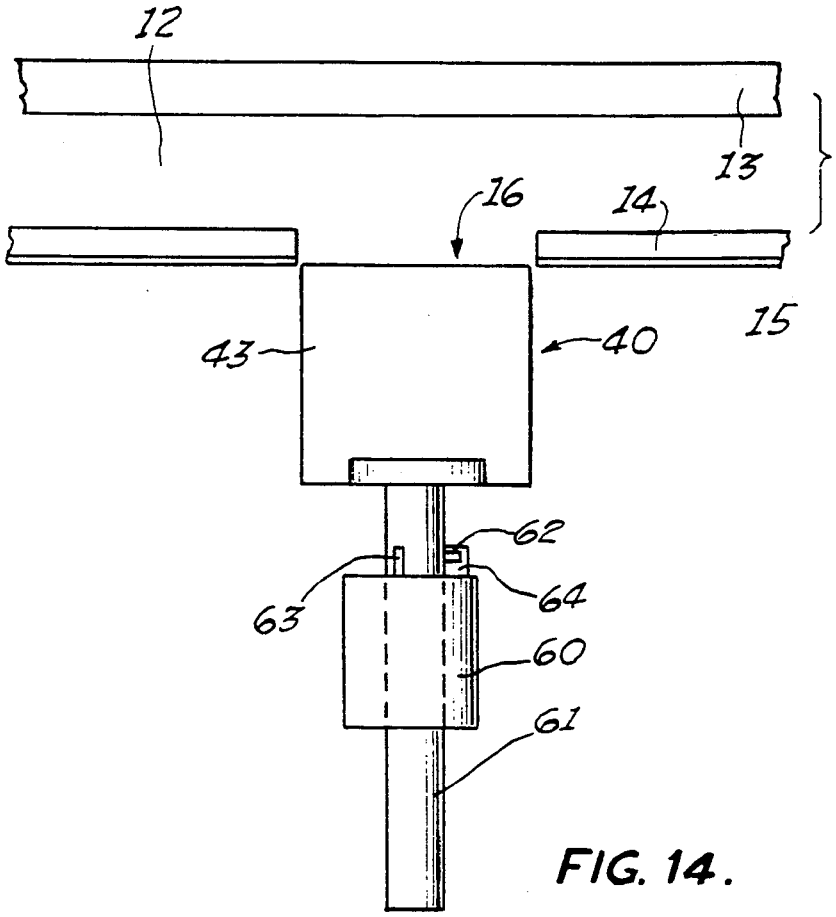
FIG. 14 is a side view of the mirror assembly and rotator-extender used in an arcade version of the invention.

An alternate embodiment of the game, which incorporates the basic elements of the game, but which is more adapted to the use to which such games are subjected in areas such as arcades, bars, movie theaters, and sporting arenas is now described. In this embodiment, the top piece 13 has no x-slots 16, and no user manipulated mirror assemblies 40 are provided. Instead, beneath the bottom piece 14, mirror assembly rotator-extenders 60 are provided, as shown in FIG. 14. A glass substrate 42 coated on both sides by a reflective coating 43, 43', which may or may not be enclosed by a mirror frame 41 is provided. This mirror assembly 40' is attached to a rotator-extender shaft 61 which extends through the rotator-extender 60.

The rotator-extender 60, upon electric control signals may raise or lower the mirror assembly 40' by means of a relay-type apparatus which moves the shaft 61 in response to electric signals In addition, the mirror assembly 40' may be rotated around the axis of the shaft 61 by an electric motor type apparatus.

A stop pin 62 is attached to the shaft 61 either above the rotator-extender 60 and below the mirror assembly 40' or below the rotator-extender 60. Stops 63, 64, corresponding in location to the location of stop pin 62, are placed 90 degrees apart on either the top or bottom of the rotator-extender 60 to limit the rotation of the mirror assembly 40' about the longitudinal axis of the shaft 61. The position of stops 63, 64 correspond to the arms of the x-slot 16 on the bottom piece 14. When stop pin 62 is in contact with one of the stops 63, 64, the mirror assembly 40' may then be extended upward through the x-slot 16 by the extender part of the rotator-extender 60. The orientation of the mirror assembly 40' corresponds to the diagonals of the x-slot 16 so the mirror assembly 40' can rise through the bottom piece 14 into the chamber 12.

The electric signal to rotate the mirror assembly 40, about the shaft 61 is generated in response to a player's command to direct the orientation of the mirror assembly 40'. The activation of the rotator-extender 60 is also clearly responsive to the determination by the player that that particular mirror assembly 40' should be used.

With this embodiment, the mirror assembly 40' is entirely contained below the top piece 13, and therefore out of physical contact by the players. In all other respects, this embodiment of the game is identical to the embodiment described in detail above.

The instant invention has been shown and described herein in what is considered to be the most practical and preferred embodiment. It is recognized, however, that departures may be made therefrom within the scope of the invention and that obvious modifications will occur to a person skilled in the art.

We claim:

1. A game comprising:
   (a) a playing area having a substantially orthogonal, substantially planar matrix including parallel rows and parallel columns, each intersecting row and column defining a square, said matrix having four major sides;
   (b) a plurality of means for projecting visually discernible paths down a row or column of said matrix;
   (c) means for angularly diverting said paths from a row to a column or a column to a row;
   (d) a plurality of scoring modules, corresponding in number to the number of players, each scoring module having means for detecting contact with said visually discernible path; and
   (e) a plurality of home bases, each comprising a square, each of said home bases adjacent to said scoring module.

2. The game of claim 1 wherein said means for projecting is a laser and said visually discernible path is a laser beam.

3. The game of claim 1 wherein each of said means for angularly diverting said path is placed diagonally across one of said squares.

4. The game of claim 3 wherein said means for angularly diverting said path is a mirror.

5. The game of claim 4 wherein said mirror is reflective on both sides.

6. The game of claim 3 wherein said matrix further comprises:
   (a) a substantially horizontal bottom piece;
   (b) a top piece maintained above said bottom piece and parallel to said bottom piece thereby creating a chamber between said bottom and said top piece through which said paths are projected.

7. The game of claim 6 wherein said top piece includes a plurality of "x"-shaped slots, each of said slots corresponding to one select square, each of said slots positioned about the diagonals across said squares, each of said slots adaptable to fixedly and frictionally secure said means for diverting said path.

8. The game of claim 6 wherein said bottom piece includes a plurality of "x"-shaped slots, each of said slots corresponding to one select square, each of said slots positioned about the diagonals across said squares, each of said slots adaptable to fixedly and frictionally secure said means for diverting said path.

9. A game comprising:

(a) an enclosed playing area; said enclosed playing area comprises a substantially orthogonal, substantially planar matrix including parallel rows and parallel columns, each intersecting row and column defining a square, said matrix having four major sides said matrix superimposed on:
  (i) a substantially horizontal bottom piece;
  (ii) a top piece maintained above said bottom piece and parallel to said bottom piece; and
  (iii) a frame connecting said bottom piece and said top piece at their outermost edge, thereby creating an enclosed chamber therebetween;

(b) at least one laser producing a laser beam within said enclosed playing area; the number of lasers producing laser beams within said enclosed playing area is at least two;

(c) means for divering said laser beam within said enclosed playing area; and said means for diverting said laser beam within said enclosed playing area comprises a plurality of mirror assemblies, selectively positionable across a select one of said squares, such that a laser beam directed down a row or column, intersecting one said mirror assemblies, is angularly directed down a corresponding column or row respectively and further comprising:
  (i) means for initially directing said laser beam down select one of said rows or select one of said columns;
  (ii) a plurality of scoring modules corresponding in number of the number of players, each scoring module having means for detecting contact by an incident laser beam; and
  (iii) a plurality of home bases each comprising a square, each of said home bases juxtaposed said scoring modules;

(d) means for rendering said laser beams visibly discernible.

10. The game of claim 9 wherein said mirror assemblies are reflective on both sides.

11. The game of claim 10 wherein at least one said top piece or bottom piece includes a plurality of "X"-shaped slots, each of said slots corresponding to one select square, each said slot positioned about the diagonals of said square, each of said slots adaptable to fixedly and frictionally secure said mirror assemblies, and wherein said mirror assemblies each comprise:

(a) a mirror , having at least one reflective surface;

(b) means, attached to said mirror, for frictionally engaging said "X"-shaped slots whereby said mirror assembly is securely and precisely located within said chamber by the interaction of said means for frictionally engaging said "X"-shaped slots and said "X"-shaped slot.

12. The game of claim 9 wherein said top piece includes a plurality of "X"-shaped slots, each of said slots corresponding to one select square, each said slot positioned about the diagonals across said squares, each of said slots adaptable to fixedly and frictionally secure said mirror assemblies.

13. The game of claim 9 wherein said bottom piece includes a plurality of "X"-shaped slots, each of said slots corresponding to one select square, each said slots positioned about the diagonal across said square, each of said slots adaptable to fixedly and frictionally secure said mirror assemblies.

14. The game of claim 9 wherein said means for detecting contact by a laser beam is chosen from a group consisting of a phototransistor, photo PIN diode, or a solar cell.

15. The game of claim 14 wherein said means for detecting contact by a laser beam further comprises a diffusing filter placed between said means for detecting contact by a laser beam and said incident laser beam whereby the cross-sectional area of said laser beam is expanded to further increase the chance of said laser beam being incident upon said means for detecting contact.

16. The game of claim 15 further comprising a first reflective surface adjacent to said diffusing filter opposite said incident laser beam, said reflective surface directed toward said incident laser beam.

17. The game of claim 16 wherein said scoring module comprises a plurality of said means for detecting contact by a laser beam, including said diffusing filters, and said first reflective surfaces, each corresponding means for detecting contact, diffusing filter and first reflective surface facing a different row or column of said matrix.

18. The game of claim 9 further comprising means, responsive to said means for detecting contact by a laser beam, for registering a score.

19. The game of claim 18 wherein said means for registering a score comprises:

(a) means for differentiating said laser beams of opposing players; and (b) means, responsive to said means for detecting contact by a laser, for detecting said differentiated lasrr beams.

20. The game of claim 19 wherein said means for differentiating said laser beams of opposing players comprises means for pulsing said laser beams and wherein said means for detecting said laser beams comprises means, responsive to said means for detecting contact by a laser beam, for detecting said pulsing laser beams.

21. The game of claim 18 further comprising means, responsive to said means for registering a score, for communicating and storing said scores.

22. The game of claim 9 wherein said means for rendering said laser beams visually discernible comprises gaseous-born impurities co-extensive with said laser beams within said chamber whereby contact between said laser beams and said gaseous-born impurities causes scattering of said laser beams thereby visually enhancing the game.

23. The game of claim 22 wherein said gaseous-born impurities are selected from a group consisting of smoke, vapor, dust, or particulates.

24. The game of claim 22 further comprising means for generating said gaseous-born impurities.

25. The game of claim 24 wherein said means for generating said gaseous-born impurities comprises:

(a) a mixture which when heated creates gaseous-born impurities; and (b) means for heating said mixture.

26. The game of claim 22 further comprising means for moving said gaseous-born impurities into diffusion with said laser beams.

27. The game of claim 22 further comprising:

(a) a mixture which when heated creates gaseous-born impurities;

(b) means for heating said mixture; and (c) means for moving said gaseous-born impurities into diffusion with said laser beams.

28. The game of claim 22 further comprising means for detecting the concentration of said gaseous-born impurities in diffusion with said laser beams.

29. The game of claim 28 wherein said means for detecting the concentration of said gaseous-born impurities in diffusion with said laser beams comprises:

(a) a source of infrared radiation;

(b) means for detecting said infrared radiation;

(c) means, responsive to said means for detecting said infrared radiation, for generating a control signal to activate said means for heating said mixture.

30. The game of claim 9 wherein said means for directing said laser beams comprises:

(a) a plurality of mirrors;

(b) means for aligning said mirrors whereby one of said laser beams projected from said laser will be reflected off of one of said mirrors in a direction down one of said rows or one of said columns.

31. The game of claim 30 wherein said means for aligning said mirrors comprises:

(a) a hemisphere rigidly attached to the back of one of said mirrors;

(b) a socket, being substantially a reverse hemisphere, corresponding in size to said hemisphere;

(c) means for securing said hemisphere to said socket, whereby said mirror is secured in position relative to said socket; and (d) means for securely orienting said soc,ket with respect to said rows and said columns.

32. The game of claim 31 wherein said means for securing said hemisphere to said socket comprises:

(a) a shaft having a first and a second end, said shaft extending away from said mirror through said hemisphere on an axis through the center of said hemisphere, said first end being encased in said hemisphere, said second end being threaded;

(b) an aperture, extending through said socket, slightly larger in diameter than the diameter of said shaft, positioned so as to receive said shaft;

(c) a nut, threadable on said second end of said shaft; whereby said second end of said shaft is placed through said aperture and said nut is threaded onto said second end thereby bringing said hemisphere into frictional and secure contact with said socket thereby fixing the orientation of said mirror to said socket.

33. A game comprising:

(a) a playing area including a substantially orthogonal, substantially planar matrix having parallel rows and parallel columns, each intersecting row and column defining a square, said matrix having four major sides said matrix superimposed on;

(i) a substantially horizontal bottom piece;

(ii) a top pieoe diametrically positioned above said bottom piece and parallel to said bottom piece thereby creating a chamber between said bottom and said top piece;

(b) a plurality of lasers each producing laser beams;

(c) means for directing said laser beams within said chamber down either one of said rows or one of said columns; said means for directing said laser beams including:

(i) a plurality of mirrors;

(ii) means for aligning said mirrors having:

(1) a hemisphere rigidly attached to the non reflecting side of one of said mirrors;

(2) a socket, corresponding in size to said hemisphere;

(3) means for securing said hemisphere to said socket, whereby said mirror is also secured in position relative to said socket; and (4) means for securely orienting said socket with respect to said rows and said columns;

whereby one of said laser beams projected from one of said lasers will be reflected off of one of said mirrors in a direction down one of said rows or one of said columns;

(d) a plurality of "X"-shaped slots, each of said slots corresponding to one select square, each of said slots diagonally positioned about said square;

(e) a plurality of mirror assemblies, each mirror assembly being selectively positionable within one said X-shaped slot, such that a laser beam directed down a row upon intersecting one of said mirror assemblies is thereafter angularly directed down a column or a laser beam directed down a column upon intersecting one of said mirror assemblies is thereafter angularly directed down a row; and each of said mirror assemblies frictionally engaging a corresponding "X"-shaped slots whereby a precise orientation of said mirror assembly is established, said mirror assemblies each having:

(i) a mirror; and (ii) a frame, protecting said mirror;

(f) a plurality of scoring modules corresponding in number of the number of players, each scoring module having a plurality of means for detecting contact by an incident laser beam, said means for detecting contact by a laser beam chosen from a group consisting of a phototransistor photo PIN diode, or a solar cell, said means for detecting contact by a laser beam further including a diffusing filter corresponding to each means for detecting contact by a laser beam, said diffusing filter placed between said means for detecting contact by a laser beam and said incident laser beam, whereby the cross-sectional area of said laser beam is expanded to further increase the chance of said laser beam being incident upon said means for detecting contact by a laser beam;

(g) a plurality of home bases each comprising a square, each of said home bases located adjacent said scoring modules;

(h) means, responsive to said means for detecting contact by a laser beam, for registering a score which includes:

(i) means for differentiating said laser beams of opposing players, said means for differentiating said laser beams comprising means for pulsing said laser beams;

(ii) means, responsive to said means for detecting contact by a laser, for detecting said laser beams;

(iii) means, responsive to said means for detecting a laser beam, for registering a score;

(i) means, responsive to said means for registering a score, for communicating said score to the players;

(j) means for rendering said laser beams visually discernible, including:

(i) gaseous-born impurities co-extensive with said laser beams whereby contact between said laser beams and said gaseous born impurities causes scattering of said laser beams thereby rendering said laser beams visually discernible, (ii) a mixture which when heated creates gaseous-born impurities;

(iii) means for heating said mixture; and (iv) means for moving said gaseous-born impurities into diffusion with said laser beams.

* * * * *